US010502035B2

(12) United States Patent
Sandkleiva

(10) Patent No.: US 10,502,035 B2
(45) Date of Patent: Dec. 10, 2019

(54) WELL TOOL MODULES FOR RADIAL DRILLING AND ANCHORING

(71) Applicant: Agat Technology AS, Stavanger (NO)

(72) Inventor: Are Sandkleiva, Kvernaland (NO)

(73) Assignee: Agat Technology AS, Stavanger (NO)

( * ) Notice: Subject to any disclaimer, the term of this patent is extended or adjusted under 35 U.S.C. 154(b) by 222 days.

(21) Appl. No.: 15/502,824

(22) PCT Filed: Aug. 19, 2015

(86) PCT No.: PCT/NO2015/050138
§ 371 (c)(1),
(2) Date: Feb. 9, 2017

(87) PCT Pub. No.: WO2016/028159
PCT Pub. Date: Feb. 25, 2016

(65) Prior Publication Data

US 2017/0234115 A1 Aug. 17, 2017

(30) Foreign Application Priority Data

Aug. 21, 2014 (NO) ..... 20141020
Aug. 21, 2014 (NO) ..... 20141022

(51) Int. Cl.
*E21B 43/112* (2006.01)
*E21B 23/01* (2006.01)

(52) U.S. Cl.
CPC ..... *E21B 43/112* (2013.01); *E21B 23/01* (2013.01)

(58) Field of Classification Search
None
See application file for complete search history.

(56) References Cited

U.S. PATENT DOCUMENTS 2,381,929 A * 8/1945 Schlumberger ..... E21B 33/14 166/100
2,915,123 A * 12/1959 Lebourg ..... E21B 49/10 166/100

(Continued)

FOREIGN PATENT DOCUMENTS

| | | |
|---|---|---|
| EP | 07910721 | 8/1997 |
| WO | 199533121 | 7/1995 |
| WO | 200009854 | 2/2000 |

OTHER PUBLICATIONS

International Search Report, PCT/NO2015/050138, dated Dec. 23, 2015.

(Continued)

*Primary Examiner* — Shane Bomar
(74) *Attorney, Agent, or Firm* — Andrus Intellectual Property Law, LLP

(57) ABSTRACT

A drilling module is for radial drilling in a well and an anchoring module is for use in a well tool. The drilling module has a piston for receiving a drill for the radial drilling, and for displacing the drill in a radial direction towards a wall of the well and a cylinder for receiving and guiding the piston. Both the piston and the cylinder are guide-free and of a non-circular shape, at least in a portion, to prevent relative rotation between them. The anchoring module has an extent in the axial direction of the well. The anchoring module includes a displacement device arranged to push against a portion of the wall of the well to press the anchoring module against an opposite portion of the wall of the well. The displacement device is oblong in the axial direction of the anchoring module.

8 Claims, 6 Drawing Sheets

(56) References Cited

U.S. PATENT DOCUMENTS 2,955,579 A 10/1960 Block
2,983,256 A 5/1961 Seeloff
3,173,500 A * 3/1965 Stuart ..... E21B 49/06 175/332
3,301,337 A * 1/1967 Vaughn ..... E21B 43/112 166/298
3,456,504 A 7/1969 Bombardieri
4,114,517 A 9/1978 Teramachi
4,158,388 A 6/1979 Owen et al.
5,183,111 A 2/1993 Schellstede
5,392,858 A 2/1995 Peters et al.
5,622,231 A 4/1997 Thompson
5,687,806 A * 11/1997 Sallwasser ..... E21B 7/061 175/62
5,746,279 A * 5/1998 Havlinek ..... E21B 7/061 166/55.1
6,167,968 B1 1/2001 Allarie et al.
6,772,839 B1 8/2004 Bond
9,097,109 B2 * 8/2015 Boekholtz ..... E21B 43/112
2003/0213590 A1 11/2003 Bakke
2004/0154809 A1 8/2004 Bakke
2006/0000606 A1 * 1/2006 Fields ..... E21B 49/06 166/264
2006/0076162 A1 4/2006 Tchakarov et al.
2011/0042077 A1 2/2011 Sherrill
2012/0211245 A1 8/2012 Fuhst et al.
2012/0222492 A1 * 9/2012 Quin ..... G01F 1/662 73/861.28
2012/0273238 A1 * 11/2012 Boekholtz ..... E21B 7/04 166/383
2013/0213645 A1 8/2013 Proett et al.
2017/0107813 A1 * 4/2017 Feng ..... E21B 4/006

OTHER PUBLICATIONS

Norwegian Search Report, Application No. 20141022, dated Feb. 24, 2015.
Written Opinion, PCT/NO2015/050138, dated Dec. 23, 2015.

* cited by examiner

WELL TOOL MODULES FOR RADIAL DRILLING AND ANCHORING

CROSS-REFERENCE TO RELATED APPLICATIONS

This application is the U.S. national stage application of International Application PCT/NO2015/050138, filed Aug. 19, 2015, which international application was published on Feb. 25, 2016, as International Publication WO 2016/028159 in the English language. The International Application claims priority of Norwegian Patent Application No. 20141020, filed Aug. 21, 2014 and Norwegian Patent Application No. 20141022, filed Aug. 21, 2014. The international application and Norwegian applications are all incorporated herein by reference, in entirety.

FIELD

The invention relates to a drilling module for radial drilling in a well, an anchoring module for well tools, and a well tool including said well tool modules.

BACKGROUND

Many mechanical operations are carried out downhole in connection with establishing, maintaining and optimizing production from oil and gas wells. Many of these operations require the tool to be held fixed in the well by anchoring in a specific place by means of anchoring devices.

Prior art in the field includes anchor systems with hydraulic pistons that are pressed against the pipe wall. It is then known to use one or more such hydraulic pistons, wherein these are distributed in the circumference of a well tool. Solutions in which hydraulic pistons cooperate with anchor systems based on the toggle-joint principle, in which an anchor foot has a link arm at either end, are known as well. One link arm is attached to the well tool and the other to a hydraulic piston. There may typically be three anchor feet connected to the same hydraulic piston. When the anchor is inactive, it lies flush with the body of the well tool. The anchor is activated by the hydraulic piston being pressurized so that the link arms are driven towards each other and the anchor feet move outwards into contact with the pipe wall. Such anchor systems are sensitive to diametrical changes in the pipe. It is also known to use a cone which drives wedges out against the pipe wall. Common to the prior-art solutions is that they hold the well tool fixed in a centred position so that the well tool is concentric with the well.

In those cases in which the well tool is to carry out operations in a radial direction, such as when perforating a pipe, the radial reach of the tool is limited. This is a challenge when a petroleum well has been drilled and is to be prepared for production, among other things. In this so-called completion phase, the well will be provided with casing which, in turn, is perforated in the areas assumed to give the best production. Perforation is also relevant in other phases of the production, in injection wells and by well intervention. Further, perforation may be performed in open wells, that is to say with no casing, to increase the extraction from a zone.

According to the prior art, a perforation tool is lowered down to the desired area in the well and the perforation tool is used to make the necessary number of holes in the casing. The perforation tool usually includes a row of small explosive charges which are detonated at the desired place. The use of explosives may give an uneven hole quality and sometimes no hole at all. The handling and transport of explosives are becoming increasingly difficult because of stricter legislation. An alternative to using explosives, which is prior art as well, is punching holes by means of hydraulic pressure. However, this is only an alternative in pipes with thin walls. Punching requires much, heavy and space-demanding equipment. It is always a challenge to have enough room for equipment in well tools which are generally of small diameters.

Radial drilling may also be used to perforate pipes. A known well tool used for this is the applicant's own tool called "MaxPERF" developed by the Canadian company Penetrators Canada Inc. Said tool drills holes with a diameter of 1" (≈25.4 mm) in casings and longer tunnels or bores with a diameter of 0.7" (≈17.8 mm) in the formation outside. These two drillings, through the casing and into the formation, respectively, are performed with two different applications accommodated in the same tool. Drilling through casing requires a steady and stable drilling device, whereas the longer tunnels can be drilled with a flexible string-shaped drill.

When perforating by means of drilling, unintentional damage to the casing and/or formation outside is avoided. By drilling, the diameter of the hole will be known and, in addition, drilling gives considerably greater control of the depth of the hole and drill-through can be verified. In connection with injection wells, injection calculations will thus be more accurate as well. With the limited diameter that a well tool has got, one of the challenges connected to drilling as the perforation method is to get a sufficient length of stroke for the drill so that even thick casings can be perforated.

SUMMARY

The invention has for its object to remedy or reduce at least one of the drawbacks of the prior art or at least provide a useful alternative to the prior art.

The object is achieved through the features which are specified in the description below.

In a first aspect, the invention relates more specifically to a drilling module for radial drilling in a well, the well being defined by a wall and the well having an extent in an axial direction, and the drilling module including:

a piston for receiving a drill for the radial drilling, and for displacing the drill in a radial direction towards the wall of the well; and a cylinder for receiving and guiding the piston, the drilling module being characterized by both the piston and the cylinder being guide-free and of a non-circular shape, at least in a portion, in order to prevent relative rotation between them.

By a "circular shape" is meant, herein, a form that has a circular basic shape, that is to say a circular circumference, for example a piston of a circular shape with grooves or guides. Correspondingly, by a "non-circular shape" is meant that the basic shape is different from the circular one, for example an oval one.

In a downhole tool, the space conditions are, as is known, limited in consequence of the size of the well bore, and then in particular for a tool that has its operation zone in a radial direction out from the downhole tool. For such tools, for example a drilling module for radial drilling, the reach will be limited by the diameter of the downhole tool.

A piston usually has circular end faces and a curved side face, and the piston of a drilling machine of a known type will typically be circular. When a circular piston and a cylinder complementarily fitting the piston are used, the piston may displace the drill towards the well wall. The cylinder housing is set into rotation via a bevel-gear drive connected to a motor, for example. Relative rotation between the cylinder and piston will be unfortunate both with a view to wear and with a view to an optimum transmission of torque to the drill. To prevent, or at least minimize, the rotation of the cylinder and piston relative to each other it is known to provide a rotation-preventing mechanism, such as guides. These guides will be positioned between the piston and the cylinder housing, as longitudinal grooves in which the piston is guided. In a drilling apparatus of a known type, there will be guides, or grooves, in an upper portion of the piston, fitting into corresponding guides/grooves in the cylinder housing. Further, such a piston in a drilling apparatus of a known type will be hydraulically operated, and the seals that are necessary to avoid leakage in the hydraulics are placed below the portion of the piston where the guides are. The seals are fixed and thus form the limit to how far out the piston can be displaced. The guides are thereby limiting to the length of stroke of the drill.

The drilling module according to the invention indicates that the piston and cylinder of a drilling module may have a different shape from circular, at least in a portion. By a non-circular shape of the piston and cylinder of the drilling module, rotation between the piston and cylinder will be prevented without space-demanding guides being required. The length of stroke of the piston, and thereby of the drill, will thus be correspondingly longer.

Accordingly, by "guide-free" is meant herein that the piston and cylinder are formed without the above-mentioned longitudinal grooves which are known from the state of the art.

The drilling module according to the invention thus contributes to the state of the art by indicating a design of the piston and cylinder which may be said to be contrary to the normal intuitive way of thinking in this special field, namely taking a different shape of the piston as a point of departure instead of modifying the circular shape and using guides for stabilization. Beyond preventing rotation between the piston and cylinder, the additional effect of space-demanding guides becoming superfluous, and thereby the length of stroke of the piston—and the reach of the drill—becoming longer, is thus achieved.

A further effect of a non-circular piston will be better power transmission because nothing of the end-face area is lost because of guides.

The piston and the cylinder may be of an oval shape, at least in a portion. An oval shape of the piston and cylinder constitutes one embodiment of the drilling module according to the invention. An oval shape is particularly appropriate with a view to wear, as the frictional forces acting on the piston and cylinder housing will be relatively more evenly distributed than with a more irregular, non-circular shape, for example. An oval shape therefore gives both great stability and little wear in addition to the extended reach as mentioned above.

The piston and the cylinder may be of a triangular shape, at least in a portion. A triangular shape constitutes one embodiment of the drilling module according to the invention. Having rounded corners may be advantageous in a triangular shape as this will reduce the surface tensions in the area in question.

The piston may be telescopic. A telescopic piston could further increase the reach of the radial drill, where this is appropriate.

The piston may be fluid-operated, which is a suitable way of driving a piston in a cylinder. The fluid entrance and exit will typically be positioned at the bottom of the cylinder, so that when the piston is being pushed out, the fluid will work against the entire end face of the piston. It will also be an advantage to provide a safety device, for example in the form of an accumulator. The hydraulic line from the accumulator may have its inlet and outlet so far up in the cylinder that even with the piston run completely out, fluid from the accumulator may push the piston back down. The accumulator may then be activated during a power failure, for example, to ensure that the piston and the drill will get back into the tool before this is pulled out of the well.

The drilling module may include a motor arranged to rotate the cylinder housing which, via the piston, rotates the drill.

In a second aspect, the invention relates to an anchoring module for use in a well tool in a well, the well being defined by a wall, and the well having an extent in an axial direction, and the anchoring module having an extent in the axial direction of the well in its position of application. The anchoring module includes a displacement device arranged to push against a portion of the wall of the well to press the anchoring module against an opposite portion of the wall of the well. What is characteristic of the anchoring module is that the displacement device is oblong in the axial direction of the anchoring module.

When, in the position of application, the displacement device of the anchoring module pushes against the wall of the well, the well tool will be displaced radially in the well. The anchoring module of the invention presses the well tool against the wall of the well, thus clamping the tool between the displacement device and the wall. In radial well operations, such as operations taking place through the wall of production tubing (so-called "through-tubing"/"thru-tubing") and radial drilling to perforate casing, the anchoring module according to the invention will give the advantage of the tool for radial operations, for example a drill, coming closer to the pipe wall, which results in increased radial reach.

The anchoring module according to the invention thus contributes by eliminating the space present between the well tool and the well, in addition to the tool being stabilized by the clamping to the wall of the well.

The anchoring module according to the invention contributes to the state of the art by indicating a way of stabilizing a tool in a well, in which the tool is pressed against the well wall. This may be said to work in the opposite way to what is usual in this special field, namely stabilizing the well tool centred or approximately centred in the well. Beyond providing a non-centred stabilization of the well tool, the additional effect of increasing the reach of the well tool in a radial direction is achieved as well.

The fact that the displacement device is oblong in the axial direction of the tool entails the possibility of forming the displacement device in such a way that it is relatively smaller in its extent in the radial direction of the well tool, while, at the same time, the same, or a larger, contact surface with the wall of the well is achieved. With, for example, a circularly shaped cross section of the displacement device, the diameter of the displacement device may maximally be the same as the diameter of the anchoring module, and thereby that of the well tool. Accordingly, the diameter of the well tool is the absolute limit to the cross section of the displacement device, because, in its passive, retracted position, the displacement device is accommodated within the anchoring device. With an oblong shape of the displacement device, the cross section may be made just as large as, or larger than, the cross section of a circular shape of the displacement device. An advantage of an increased cross section of the displacement device is increased stability in the anchoring of the well tool. A particular advantage of an oblong shape of the displacement device is that inside the well tool, space is given for cables and other components to pass the displacement device. Since the cross section of the anchoring module may be very small, an oblong displacement device will provide greater force than, for example, a circular displacement device which is necessarily limited by the cross section of the anchoring module.

The displacement device may include at least one displacement element. The use of one displacement element constitutes one way of making the displacement device. Where the displacement device includes only one displacement element, the displacement device and the displacement element may, in a preferred embodiment, be one and the same. Where the displacement device includes two or more displacement elements, the displacement device may be regarded as a housing or a container from which the displacement elements project in a position of application. Each displacement element is thus smaller in cross section than the displacement device. The overall contact surface between the displacement elements and the wall of the well is thus limited by the dimensions of the displacement device. By using two or more displacement elements, it is also conceivable to have an embodiment in which the displacement elements may be displaced independently of each other, thus giving a more flexible anchoring module. This could be an advantage, for example where the anchoring module is used in an open well or in other places where the well wall may be uneven. The displacement elements may be identical, or they may be non-identical and adapted to the shape of the displacement device.

The displacement elements may be placed along a common axis which is parallel to the axial direction of the anchoring module. In those cases in which the displacement device includes more than one displacement element, the best effect, with a view to pressing the well tool against the wall of the well, will be achieved if the displacement elements are placed one behind the other along an axis which is parallel to the axial direction of the anchoring module, and thereby that of the well tool.

The displacement device may have an axial extent which is orthogonal to the axial direction of the well tool, which will be an advantage, from a purely spatial point of view, inside the well tool. In addition, such an orientation of the displacement device relative to the well tool will be the most appropriate when it comes to stability and the transmission of force.

The at least one displacement element may be telescopic. Telescopic displacement elements make it possible to use the anchoring module in well tools in pipes and wells with a wider spectre of dimensions. An example may be that the tool is moved through a 7" pipe and into a 9⅝" pipe to be anchored therein.

The displacement device may be oval. An oval shape of the displacement device is a particularly practical variant of the above-mentioned oblong shape. The oval shape allows the use of simple seals known from before, thus making the production and the operation of the displacement device simpler and more inexpensive than if components have to be specially adapted. By hydraulic operation of the displacement device, the oval shape will make it easy to avoid leakages. The oval shape preferred the most is the ellipse.

The displacement device may be fluid-operated. By fluid operation, usually hydraulic operation, the displacement device and its displacement elements then function as a cylinder and pistons. Having an oval shape of the displacement device and displacement elements is particularly suitable in a hydraulically operated displacement device as it is easier to avoid leakages than if the displacement device has a shape including corners or protrusions, for example.

The anchoring module may further include a safety device for releasing the pressure of the anchoring module against the well wall. If the well tool loses its power supply or becomes stuck or other problems arise, so that the displacement element cannot be retracted in a normal way, the safety device may form a backup solution for having the anchoring module released from its clamped position against the well wall. Such a safety device may include a device for cutting the displacement element, or a device for pulling or pushing the displacement element back in. One way of doing this is to machine a groove into the inside of the displacement element so that, at a given force, it will shear off. Another possible safety device may consist of springs which are arranged inside or outside the displacement element and which are arranged to retract the displacement element.

The safety device may include an accumulator. The accumulator may be charged, for example by a spring being tensioned when the piston is retracted for the first time. This charging may be performed before the well tool with the anchoring module is carried into the well, or as a testing of the accumulator after the well tool has been carried in to the desired position in the well, and before the well operation starts. The hydraulic line to the accumulator is provided with a check valve so that the accumulator will not discharge. The displacement element or piston is run out to the well wall and anchored by a given hydraulic pressure working against the accumulator pressure, where, in an emergency, the accumulator pressure will be enough to retract the displacement element into the anchoring module. Therefore, if the power supply to the anchoring module fails, the stored energy in the accumulator will function as a backup.

The safety device may be arranged to be able to withdraw the displacement device from the wall of the well. The effect of this will be that if, for example, power supply to the anchoring module is lost while this is activated, accordingly while the displacement device or the at least one displacement element is projecting from the anchoring module, the safety device will be able to withdraw the displacement device or the displacement element from the wall of the well. This is done by the tensioned spring in the accumulator being released so that hydraulic oil is forced out of the safety device and via a hydraulic line onto a surface on the top side of the lower part of the displacement element, driving the displacement element back into the anchoring module.

In a third aspect, the invention relates to a well tool which includes the drilling module according to a first aspect of the invention. The drilling module is thus one of two or more modules forming the well tool. The drilling module may be placed in the well tool wherever it is the most practical in relation to other modules. It must be understood that the well tool may also include more than one drilling module. This will give the possibility of drilling more holes in a shorter time and increasing the number of holes that can be drilled per trip, thus before the well tool has to be pulled out again to have the drill of the drilling module replaced.

The well tool may further include an anchoring module according to a second aspect of the invention which is connected to the drilling module, wherein the displacement device of the anchoring module is positioned on the opposite side from the drill of the drilling module in the position of application.

The well tool may include several modules in addition to the drilling module, wherein it must be understood that the drilling module is not necessarily positioned separately, but may be part of a larger tool module. The well tool may include an anchoring module which works in such a way that when the displacement device of the anchoring module is pushing against the well wall in its position of application, the well tool will be displaced radially in the well. The anchoring module may press the well tool against the well wall and thus clamp the tool between the displacement device and the well. In radial well operations, such as radial drilling for perforating casing for example, said anchoring module will give the advantage of the drilling module coming closer to the pipe wall and being held clamped, which results in an increased length of stroke for the radial drilling, therefore increased radial reach of the well-operation device seen in relation to the use of anchoring devices anchoring the tool centred in the well.

In a fourth aspect, the invention relates to a well tool which includes the anchoring module according to a second aspect of the invention.

The anchoring module is thus one of two or more modules that form the well tool. The anchoring module may be positioned in the well tool wherever it is the most practical in relation to other modules. It must be understood that the well tool may also include two or more anchoring modules according to the invention.

The well tool may further include a well-operation device connected to the anchoring module, the well-operation device having an operating zone for carrying out well operations, the well-operation device being positioned on the opposite side from the displacement device of the anchoring module.

The well tool may include several modules in addition to the anchoring modules, wherein it must be understood that the anchoring module is not necessarily positioned separately, but may be part of a larger tool module. The well tool may include a well-operation device. By a well-operation device is meant, here, a tool for use in various well operations. For the closest possible contact with the wall of the well, it is thus an advantage if the anchoring module is positioned on the opposite side from the well-operation device, or tool part, which needs the largest possible radial reach. The fact that said well-operation device is placed on the opposite side from the displacement device of the anchoring module involves the fact that as the anchoring module is activated and the one or more displacement elements of the displacement device push against the wall of the well, the well-operation device will come closer and closer to the opposite wall of the well, until close contact has been achieved. In this way, the distance between the well-operation device and the wall of the well is eliminated, and the radial reach of the well-operation device is increased correspondingly. For further increased stability, an anchoring module may be placed on each side of the well-operation device.

The well-operation device may be a drilling module for radial drilling according to a first aspect of the invention.

Both the drilling module and the anchoring module make use of the principle of a non-circular, preferably oval, shape of the piston and cylinder. For the drilling module, this results in, among other things, increased length of stroke of the drill, and for the anchoring module, it results in, among other things, more room inside the tool for extending hydraulic lines and other cables. In a tool in which it is combined with the drilling module, the anchoring module according to the invention will move the drilling module into contact with the well wall and thus further increase the reach of the drill, as the distance between the tool and the well wall is eliminated. In tools in which several modules are interconnected, the safety device, for example in the form of an accumulator which is described herein, may function as a safety device for several of the modules at the same time. That is to say, in a well tool with both an anchoring module and a drilling module as described above, for example, the accumulator may retract both the displacement elements of the anchoring module and the piston and drill of the drilling module.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
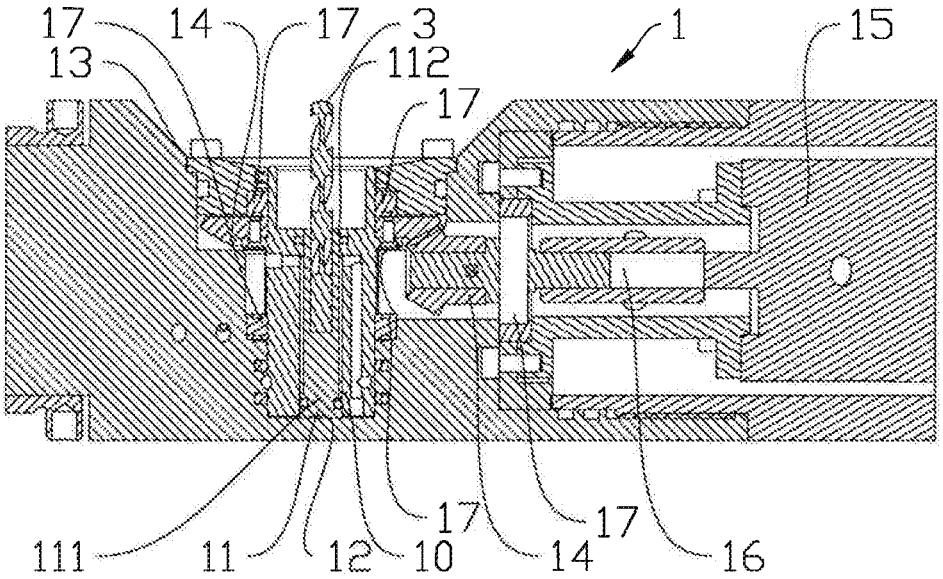
FIG. 1 shows a lateral section of a drilling module for radial drilling, with the drill retracted.

Like or corresponding elements are indicated by the same reference numerals in the figures.

Specifications of position and orientation, such as upper, lower, above, below, vertical and horizontal refer to the position shown in the figures.

FIG. 1 shows a longitudinal section of a drilling module 1 in a passive position. In the drilling module 1 is shown, here, a recess 13 or opening 13 in which a cylinder housing 10 and a cylinder 12 are accommodated. The cylinder housing 10 may also be referred to as a rotary body 10 as it is set into rotation by means of a motor 15 via a system for power and rotation transmission which includes, for example, a shaft 16, necessary ball bearings 17 and two gears 14 forming a bevel-gear drive, one gear 14 of which is attached to the cylinder housing 10, for example with screws. The motor 15 may be an electric motor or a fluid-operated motor, for example. The motor 15 and the system for power and rotation transmission to the cylinder housing 10 of the drilling module 1 will not be described in further detail herein as they are prior art known per se and are considered to be obvious to a person skilled in the art.

The cylinder 12 is arranged to receive and guide a piston 11, alternatively called a feeding plunger 11. The piston 11 and the cylinder 12 are of a non-circular shape, at least in a portion, and a continuously smooth inner diameter surface 4 along its axial length without any radially inwardly protruding guide rotationally interlocking the piston and cylinder. In FIG. 1, the section through the piston 11 and cylinder 12 has been made across the smallest diameter, whereas the piston 11 and cylinder 12 of FIG. 2 have been rotated 90 degrees in relation to in FIG. 1. Thus, the non-circular shape, oval in this case, of the piston 11 and cylinder 12 appears. The shape of the piston 11 is shown best in FIG. 4. The piston 11 is further arranged to receive a drill 3. In both FIG. 1 and FIG. 2, the piston 11 is shown fully retracted into the cylinder 12. During drilling, the piston 11, which is shown here as hydraulically operated, will be carried upwards in the cylinder 12, accordingly in a radial direction out towards a well wall 21 (shown in FIG. 10). The entrance and the exit for hydraulic oil are at the bottom of the cylinder housing 10, but are not shown in the figures as the hydraulic operation of a piston in a cylinder is considered to be technically obvious. The piston 11 and the cylinder 12 are formed in such a way that the piston 11 cannot rotate in the cylinder 12, for example by a first portion 111 of the piston 11 being oval in its circumference and being tightly enclosed by a correspondingly oval shape of the cylinder 12. The rotation of the cylinder housing 10 will thus be transmitted to the piston 11 and through this to the drill 3. The drill 3 is attached to a second portion 112 of the piston 11.

Figure 2:
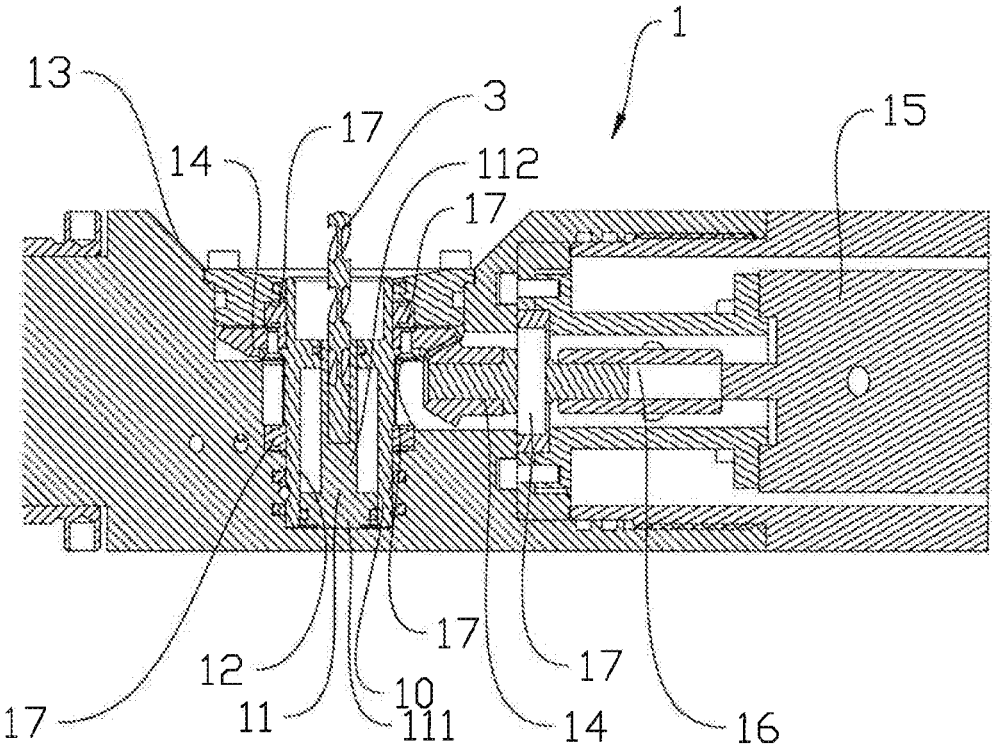
FIG. 2 shows a lateral section of the drilling module with the drill retracted, the piston and the cylinder having been rotated 90 degrees in relation to in FIG. 1.
Figure 3:
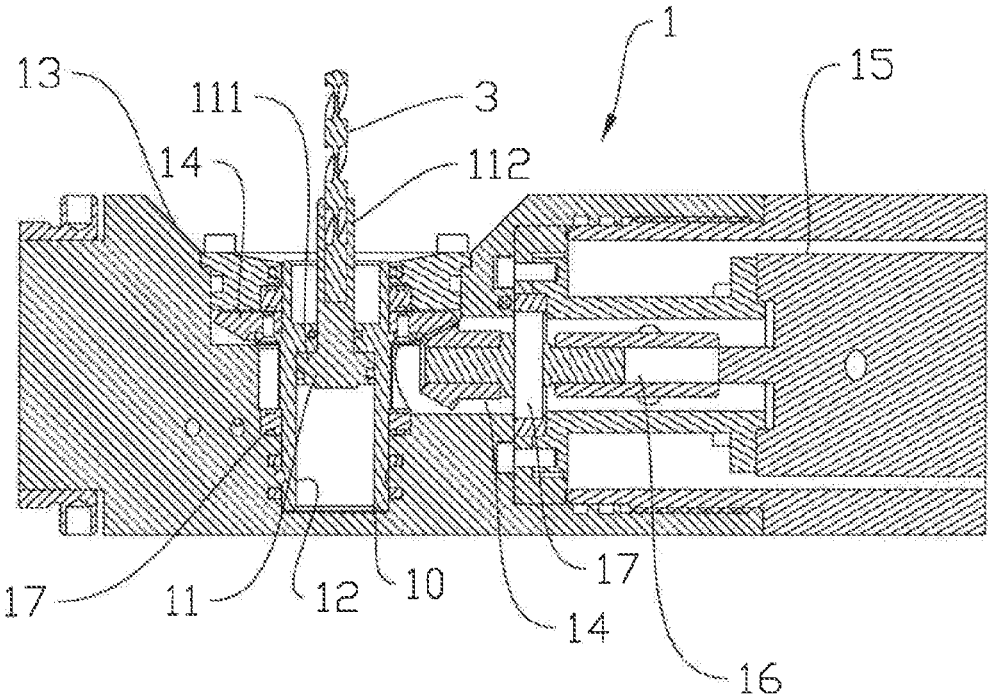
FIG. 3 shows a lateral section of the drilling module in FIG. 2, but with the drill pushed out.

FIG. 3 shows the drilling module 1 of FIG. 2, but with the piston and thereby the drill 3 at maximum displacement relative to the cylinder 12.

Figure 4:
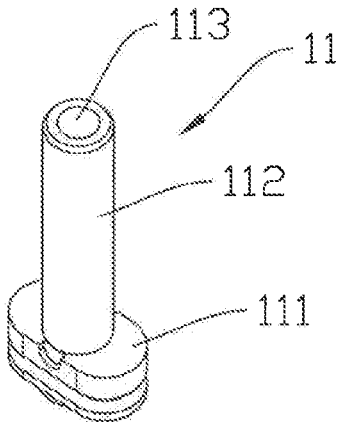
FIG. 4 shows an exemplary embodiment of a piston according to the invention.

In FIG. 4 is shown, as mentioned above, a piston 11 with a first portion 111 which is oval. In this embodiment, the piston 11 has a second portion 112 which is circular. The drill 3 (shown in FIGS. 1-3) is received and attached in a recess 113 in the second portion 112 of the piston 11.

Figure 5:
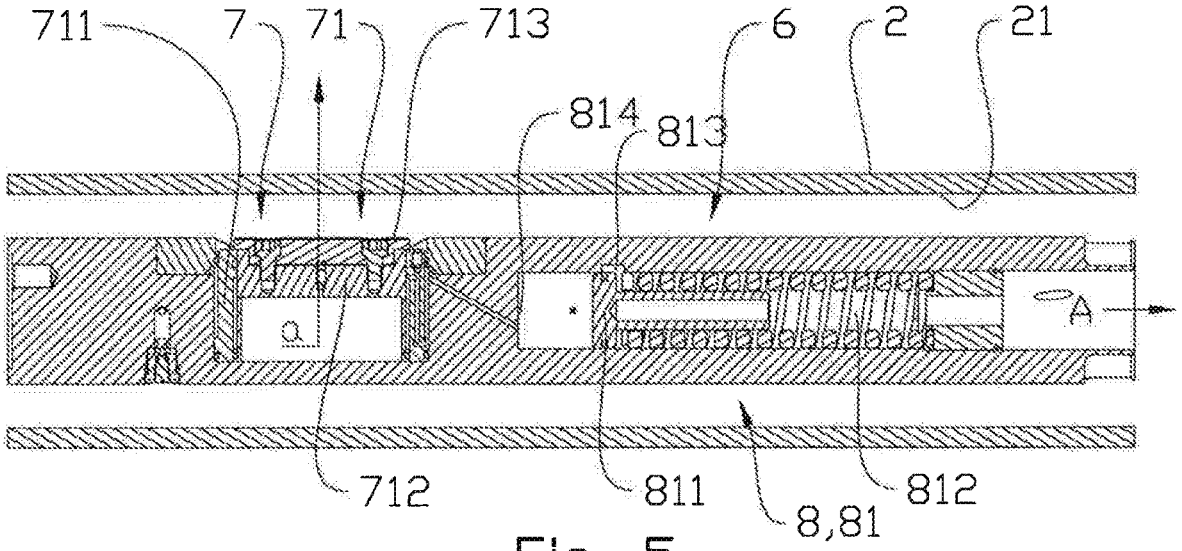
FIG. 5 shows a longitudinal section of an anchoring module in a well, the anchoring module being in a passive position.

FIG. 5 shows an anchoring module 6 in the well 2, the well 2 possibly comprising a casing 2, and the well 2 being defined by the wall 21. The anchoring module 6 is part of a larger well tool 5 (see FIG. 10). In the exemplary embodiment shown here, the well tool 5 and thereby the anchoring module 6 are run into the well 2, approximately centred in the well 2. It is also possible to run the well tool 5 into the well 2 in contact with the wall 21 of the well. The anchoring module 6 has an axial direction A which is approximately parallel to the longitudinal direction of the well 2. The anchoring module 6 is provided with a displacement device 7, the displacement device 7 being shown here in the form of one displacement element 71 which comprises an outer piston 711, an inner piston 712 and a foot 713. In other embodiments, it is conceivable for the displacement device 7 to include several displacement elements 71. The foot 713 forms the contact surface of the displacement element 71 against the well 2 in the position of application. The inner piston 712 and the outer piston 711 are fluid-operated and activated in such a way that they project from the anchoring module 6 into contact with the well wall 21 and are then pushed further out until the anchoring module 6 achieves close contact with the opposite well wall 21 and is clamped against this.

In an embodiment with several displacement elements 71, it is further conceivable that the displacement elements 71 may share one or more elements. For example, it is conceivable that several displacement elements 71 may share one foot 713, in order thus to have a larger contact surface against the internal wall 21 of the well 2.

In the embodiment shown, the displacement device 7 has an axial direction a which is orthogonal to the axial direction A of the anchoring module 6.

In FIG. 5 is further shown a safety device 8 in the form of an accumulator 81 which includes an accumulator piston 811, a spring 812 and a bleed-off port 813. The accumulator 81 is charged as the outer piston 711 and the inner piston 712 of the displacement element 71 are activated for the first time. Hydraulic oil is forced in under the two pistons 711, 712 until they have been pushed out all the way, and hydraulic oil then runs on through a hydraulic inlet line 814 of the accumulator 81, so that the accumulator piston 811 is forced back. The energy is stored by the spring 812 being tensioned. A check valve (not shown) in the hydraulic inlet line 814 of the accumulator 81 prevents the accumulator 81 from discharging. The two pistons 711, 712 are provided with seals in a technically obvious manner as known for hydraulic pistons.

Figure 6:
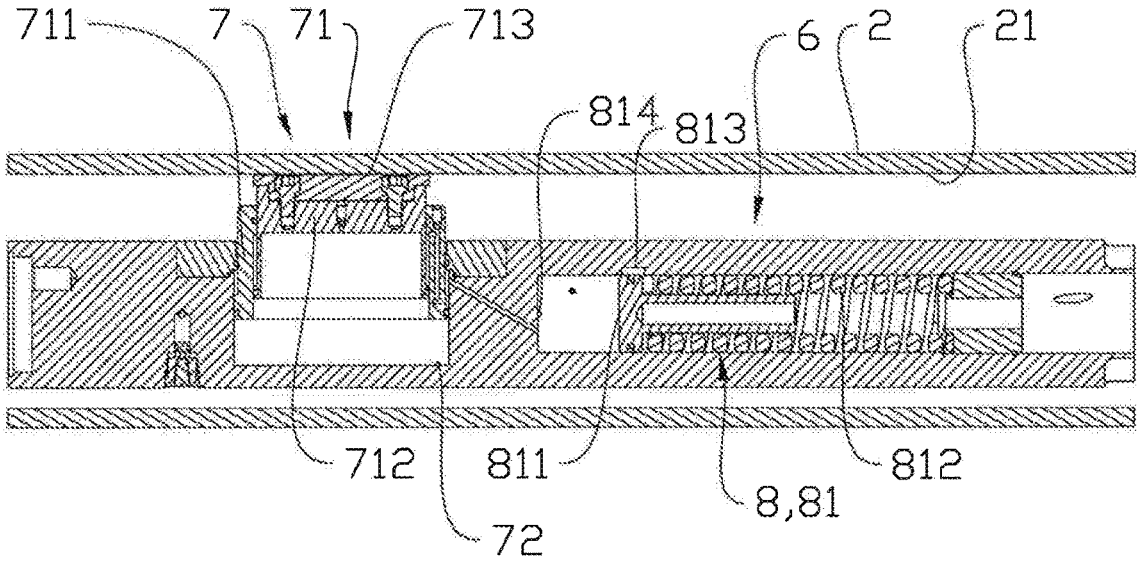
FIG. 6 shows the anchoring module of FIG. 5, but where a displacement element is in contact with the wall of the well.

FIG. 6 shows the same anchoring module 6 as FIG. 5, the only difference being that the outer piston 711 and the inner piston 712 are activated so that the foot 713 of the displacement element 71 has been moved into contact with the wall 21 of the well 2 and the anchoring module 6 thus has been displaced in the direction of the opposite wall 21.

An in- and outlet 72 for a hydraulic line for the extension and retraction of the displacement element 71 has been indicated. When the displacement element 71 of the displacement device 7 is activated, the hydraulic oil will enter through the in- and outlet 72 and press against the bottom side of both the outer piston 711 and the inner piston 712. The pistons 711, 712 are thus displaced outwards in the axial direction a into contact with the well wall 21. Conversely, a surface on the top side of the piston is pressurized to push the piston back. The accumulator pressure works against the pressure with which the pistons 711, 712 are forced outwards. The bleed-off port 813 ensures that a pressure so high that the system locks will not build up in the accumulator 81.

Figure 7A:
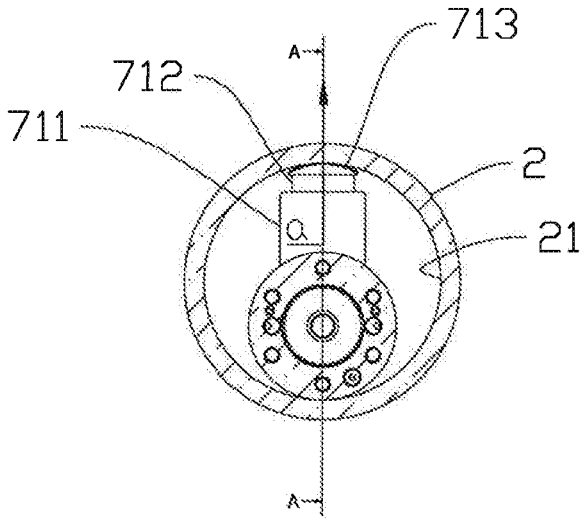
FIG. 7*a* shows a cross section of a well with an anchoring module in which both the displacement element and the anchoring module are in contact with the wall of the well, on the opposite side from each other.
Figure 7B:
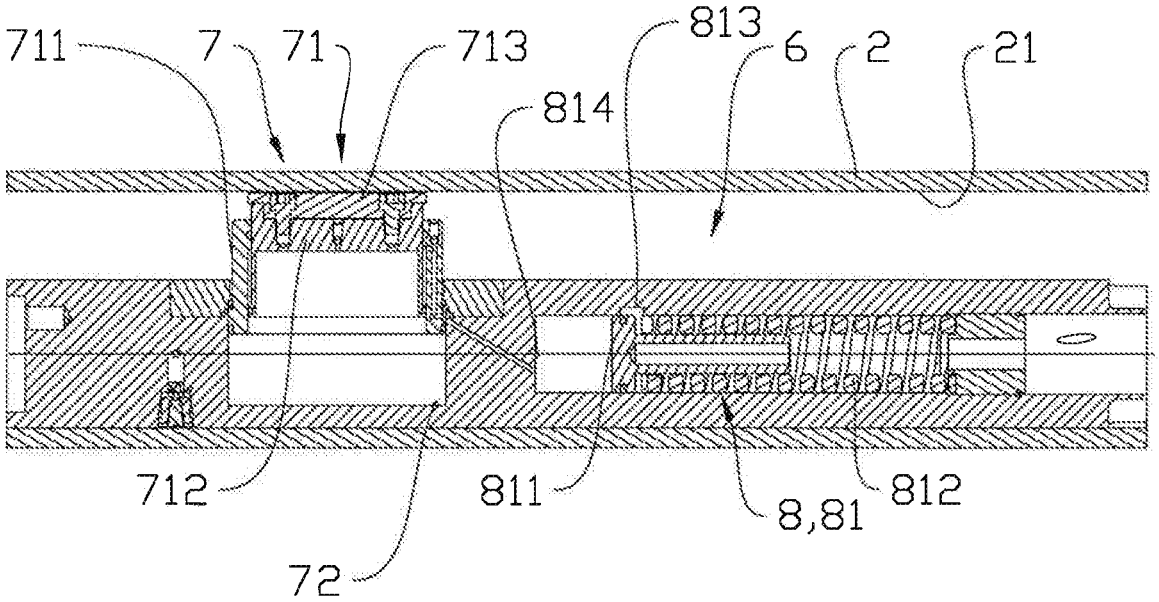
FIG. 7*b* shows a longitudinal section along the line A-A indicated in FIG. 7*a;*

In FIG. 7*a* is shown a cross section of the well 2 or the casing 2 in which the well tool 5 including the anchoring module 6 is located. It can be seen from the figure that the displacement device 7 is in its extended position with the foot 713 in contact with the wall 21 of the well 2 and the opposite side of the anchoring module 6 has achieved contact with the wall 21 of the well 2, so that the anchoring module 6 is clamped in the well 2. The line A-A is indicated in the figure and the section A-A is shown in FIG. 7*b*.

The fact that, in this exemplary embodiment, there are an outer piston 711 and an inner piston 712 indicates that the displacement element 71 is telescopic. Displacement elements 71 with further possibilities of extension through more telescopic links are conceivable in the same way as a displacement device 7 which is not telescopic is conceivable.

Figure 8:
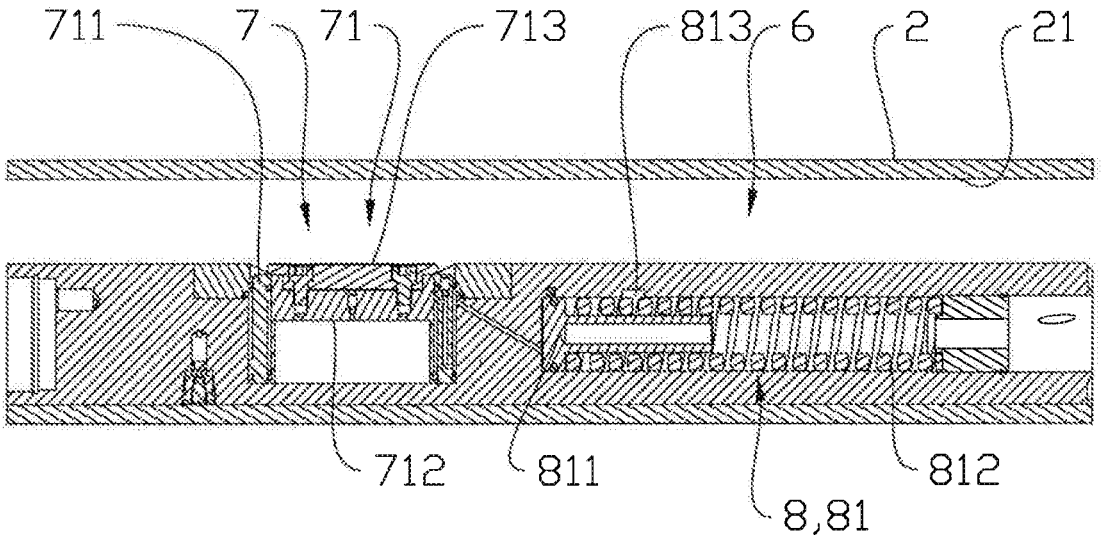
FIG. 8 shows a longitudinal section corresponding to FIG. 7*b*, but in which the safety device has been activated and the displacement element retracted.

FIG. 8 shows the situation after the displacement element 71 has been withdrawn by means of the safety device 8, shown here as an accumulator 81. When the safety device 8 is activated, the spring 812 is released, so that the accumulator piston 811 forces the hydraulic oil back through the hydraulic line 814 of the accumulator 81 and onto a surface (not shown) above the seals of the outer piston 711 and the inner piston 712, respectively, so that the two pistons 711, 712 are pushed back, into the anchoring module 6. The displacement device 7 is deactivated, that is to say withdrawn from the wall 21 of the well 2. Now, the anchoring module 6 and thereby the well tool 5 of which the anchoring module 6 forms part, are not clamped any longer, and can be pulled out if desired.

Figure 9:
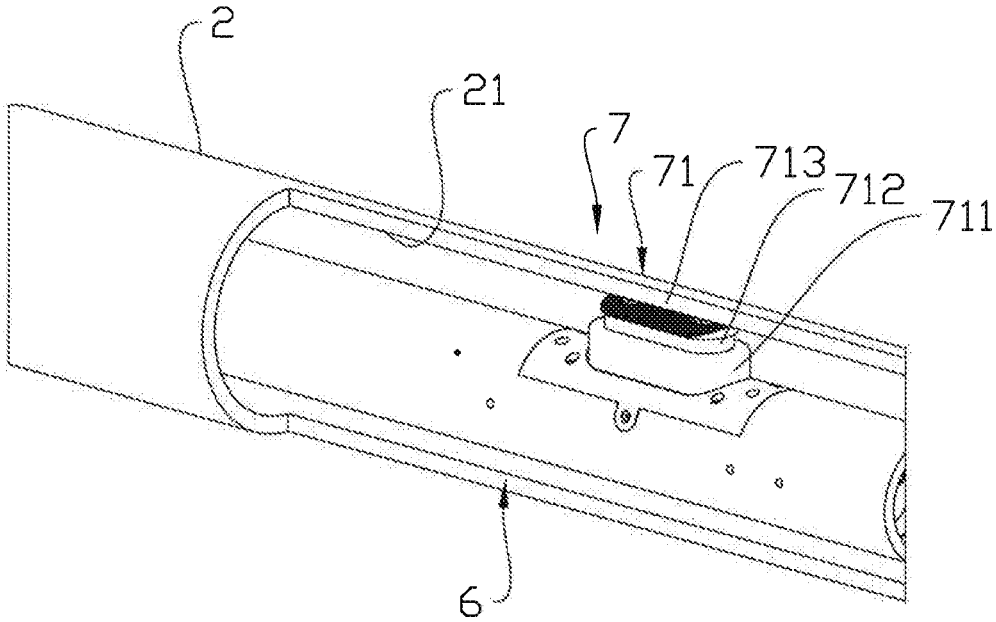
FIG. 9 shows a partially cut-away perspective view of an anchoring module in a casing.

In FIG. 9, the anchoring module 6 is shown in perspective in a partially cut-away casing 2. The displacement device 7 is shown here in the form of a telescopic, oval displacement element 71. The oval shape ensures a best possible power transmission, and to further contribute to stability and power transmission, the contact surface of the foot 713 may be slightly curved, for example adapted to the relevant curvature of the well 2. The foot 713 itself may preferably be formed in tempered steel or another suitable material and maybe with grooves or some other means for increased friction against the well wall 21.

Figure 10:
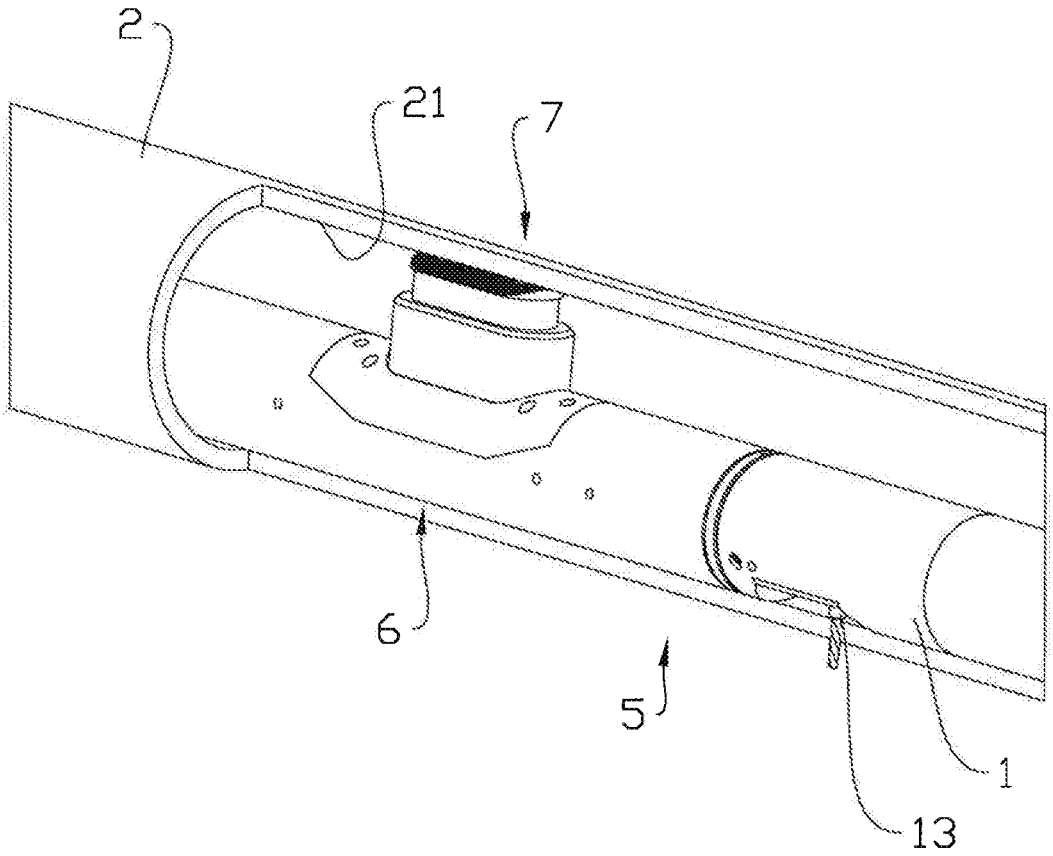
FIG. 10 shows a well tool including an anchoring module and a drilling module for radial drilling.

FIG. 10 shows the anchoring module 6 as it forms part of the well tool 5, the well tool 5 also including a well-operation device 9, shown here in the form of the drilling module 1 for radial drilling. The anchoring module 6 and the well-operation device 9 are preferably placed on the opposite side from each other, so that as the anchoring module 6 pushes the well tool 5 towards the wall 21 of the well 2, the well-operation device 9 will come into contact with the wall 21 and thus achieve its maximum radial reach.

The drilling module 1 and the anchoring module 6 are preferably positioned in the vicinity of each other, maybe next to each other, in the well tool 5. The drilling module 1 and the anchoring module 6 are further preferably positioned in such a way in the well tool 5 that, in the position of application, the displacement device 7 and the piston 11 project in opposite directions. As the anchoring module 6 pushes the well tool 5 towards the wall 21 of the well 2, the drilling module 1 will come into contact with the wall 21 and thus achieve further axial reach.

It should be noted that all the above-mentioned embodiments illustrate the invention, but do not limit it, and persons skilled in the art may construct many alternative embodiments without departing from the scope of the dependent claims. In the claims, reference numbers in brackets are not to be considered restrictive. The use of the verb "to comprise" and its various forms does not exclude the presence of elements or steps that are not mentioned in the claims. The indefinite article "a" or "an" before an element does not exclude the presence of several such elements. The invention may be implemented by means of hardware comprising several separate elements and by means of a suitably programmed computer. In apparatus claims that mention several means, several of these means may be included in one and the same element of the hardware. The fact that some features are mentioned in mutually different dependent claims does not indicate that a combination of these features cannot be used with advantage. In the figures, like or corresponding features are indicated by the same reference numbers or markings.

The invention claimed is:

1. A drilling module for radial drilling in a well, the well being defined by a wall and the well having an extent in an axial direction, the drilling module comprising:

a piston for receiving a drill for the radial drilling, and for displacing the drill in a radial direction towards the wall of the well; and a cylinder for receiving and guiding the piston, the cylinder having an inner diameter surface without any longitudinally extending guide and groove rotationally interlocking the piston and cylinder;

wherein both the outer diameter of the piston and the inner diameter of the cylinder have a correspondingly non-circular shape, at least in a portion, to thereby prevent relative rotation there between; and wherein the drilling module comprises a motor arranged to rotate the cylinder which in turn, via the piston and the correspondingly non-circular shape of the outer diameter of the piston and inner diameter of the cylinder, rotates the drill.

2. The drilling module according to claim 1, wherein the piston and the cylinder have an oval shape, at least in a portion.

3. The drilling module according to claim 1, wherein the piston and the cylinder have a triangular shape, at least in a portion.

4. The drilling module according to claim 1, wherein the piston is telescopic.

5. The drilling module according to claim 1, wherein the piston is fluid-operated.

6. A well tool comprising a drilling module for radial drilling in a well, the well being defined by a wall and the well having an extent in an axial direction, the drilling module comprising:

a piston for receiving a drill for the radial drilling, and for displacing the drill in a radial direction towards the wall of the well; and a cylinder for receiving and guiding the piston, the cylinder having an inner diameter surface without any longitudinally extending guide and groove rotationally interlocking the piston and cylinder;

wherein both the outer diameter of the piston and the inner diameter of the cylinder have a correspondingly non-circular shape, at least in a portion, to thereby prevent relative rotation there between; and wherein the drilling module comprises a motor arranged to rotate the cylinder which in turn, via the piston and the correspondingly non-circular shape of the outer diameter of the piston and inner diameter of the cylinder, rotates the drill.

7. The well tool according to claim 6, comprising an anchoring module, which is connected to the drilling module, a displacement device of the anchoring module being placed on the opposite side from the drill of the drilling module in the position of application of the displacement device.

8. A well tool comprising:

an anchoring module for use in a well tool in a well, the well being defined by a wall and the well having an extent in an axial direction, the anchoring module comprising:

in a position of application of the anchoring module, an extent in an axial direction of the anchoring module that is parallel to the axial direction of the well, and a displacement device arranged to push against a portion of the wall of the well to thereby press the anchoring module against an opposite portion of the wall of the well, wherein the displacement device comprises a piston that is oblong in the axial direction of the anchoring module;

wherein the well tool comprises:

a well-operation device connected to the anchoring module, the well-operation device having an operation zone for carrying out well operations, the operation zone of the well-operation device being positioned opposite to the displacement device of the anchoring module;

wherein the well-operation device is a drilling module for radial drilling in a well, the well being defined by a wall and the well having an extent in an axial direction, the drilling module comprising:

a piston for receiving a drill for the radial drilling, and for displacing the drill in a radial direction towards the wall of the well; and a cylinder for receiving and guiding the piston, wherein both the outer diameter of the piston and the inner diameter of the cylinder have a non-circular shape, at least in a portion, to thereby prevent relative rotation there between, for radial drilling in a well.

* * * * *